US011512924B1

(12) United States Patent
Xiao

(10) Patent No.: US 11,512,924 B1
(45) Date of Patent: Nov. 29, 2022

(54) BOW ASSEMBLY WITH MOVABLE WINDING ASSEMBLY

(71) Applicant: Shandong Han Shan Composite Material Technology Co., Ltd., Weihai (CN)

(72) Inventor: Riguo Xiao, Weihai (CN)

(73) Assignee: Shandong Han Shan Composite Material Technology Co., Ltd., Weihai (CN)

( * ) Notice: Subject to any disclaimer, the term of this patent is extended or adjusted under 35 U.S.C. 154(b) by 0 days.

(21) Appl. No.: 17/577,045

(22) Filed: Jan. 17, 2022

(30) Foreign Application Priority Data

Dec. 6, 2021 (CN) ..... 202111477087.8

(51) Int. Cl.
*F41B 5/12* (2006.01)
*F41B 5/14* (2006.01)

(52) U.S. Cl.
CPC ..... *F41B 5/1469* (2013.01); *F41B 5/12* (2013.01); *F41B 5/123* (2013.01); *F41B 5/143* (2013.01)

(58) Field of Classification Search
CPC ..... F41B 5/10; F41B 5/12; F41B 5/123
See application file for complete search history.

(56) References Cited

U.S. PATENT DOCUMENTS

| | | | | |
|---|---|---|---|---|
| 9,297,604 | B1 * | 3/2016 | Sidebottom | F41B 5/105 |
| 10,393,470 | B1 * | 8/2019 | Popov | F41B 5/105 |
| 2014/0261358 | A1 * | 9/2014 | Pulkrabek | F41B 5/105 29/428 |
| 2019/0137212 | A1 * | 5/2019 | Yehle | F41B 5/105 |
| 2020/0011634 | A1 * | 1/2020 | Walthert | F41B 5/105 |

* cited by examiner

*Primary Examiner* — John A Ricci
(74) *Attorney, Agent, or Firm* — Bayramoglu Law Offices LLC

(57) ABSTRACT

A bow assembly includes a bow body assembly that pulls a string to shoot an arrow by a force generated by a rebound of an elastic body, where the bow body assembly is pivotally connected to a winding assembly for winding the string; and the winding assembly slides from a first position of the bow body assembly to a second position of the bow body assembly through a sliding assembly. The bow assembly involves manual winding, but the manual winding process will not exert any force on a limb, and a winding wheel can be moved by driving the sliding assembly by pedaling. In a shooting phase, the winding assembly is fixed relative to a bow body. In addition, the energy efficiency enhancer enables the winding wheel to continue to rotate after a limited number of revolutions. Further, as the winding wheel will not stop abruptly, noise is reduced.

20 Claims, 9 Drawing Sheets

BOW ASSEMBLY WITH MOVABLE WINDING ASSEMBLY

CROSS REFERENCE TO THE RELATED APPLICATIONS

This application is based upon and claims priority to Chinese Patent Application No. 202111477087.8, filed on Dec. 6, 2021, the entire contents of which are incorporated herein by reference.

TECHNICAL FIELD

The present disclosure relates to the technical field of bow and arrow manufacturing, and in particular to a bow assembly with a movable winding assembly.

BACKGROUND

At present, the winding assemblies of the widely used bows on the market are generally provided at two positions. First, the winding assembly is provided at the movable end of the limb. When the limb rebounds, the limb drives the winding assembly to move together, such that the winding assembly consumes the kinetic energy generated by the rebound of the limb, thereby reducing energy efficiency. In addition, a lot of force must be applied to deform the limb for manual winding. Second, the winding assembly is fixed to the bow body, which prevents the limb from consuming kinetic energy, but the winding process is still laborious.

SUMMARY

In order to overcome the shortcomings of the prior art, the present disclosure provides a bow assembly with a movable winding assembly.

In order to solve the above technical problem, the present disclosure adopts the following technical solution, a bow assembly with a movable winding assembly, including a bow body assembly that pulls a string to shoot an arrow by a force generated by a rebound of an elastic body, where the bow body assembly is pivotally connected to a winding assembly for winding the string;

the winding assembly slides from a first position of the bow body assembly to a second position of the bow body assembly through a sliding assembly; and a connection point of the string on the winding assembly moves with the winding assembly; and the string between the winding assembly and the elastic body carries and transmits a pulling force generated by the movement of the winding assembly to the elastic body, such that the elastic body is deformed.

Further, the string may include at least a first string and a second string;

one of the first string and the second string may be wound on the winding assembly, and may be unwound from the winding assembly by an external force; and the other string may be connected between the winding assembly and the elastic body; an external force may be transmitted to the winding assembly through the one string, and then transmitted to the elastic body through the other string to deform the elastic body; and the elastic body may not be directly connected to the string that receives the external force.

Further, the string connected between the winding assembly and the elastic body on the same side may be always at an angle of less than 90° to the elastic body.

Further, the first string and the second string may have opposite winding directions on the winding assembly.

Further, at least one pre-tensioning member may be provided on the string; the pre-tensioning member may rotate by its own torsion force to wind the string and shorten the length of the string; and alternatively, when the winding assembly moves, the pre-tensioning member may rotate against its own torsion force to release the string, so as to compensate for a moving distance.

Further, the sliding assembly may drive the winding assembly to move under the action of an external force.

Further, the sliding assembly may include at least one rotating member; and the rotating member may rotate to drive the winding assembly matched there-with to move.

Further, the rotating member may be matched with an anchoring member that allows the rotating member to rotate in only one direction.

Further, the winding assembly may include at least one winding wheel wound with the string; and an energy efficiency enhancer may be provided between any winding wheel and the winding assembly, which may allow the winding wheel to continue to rotate after the winding assembly stops rotating.

Further, the bow body assembly may be provided with an arrow supporting structure;

the arrow supporting structure may include an arrow support; and the arrow support may rotate with a central part thereof, which may serve as a pivot point; when rotating in a first direction, the arrow support may enter an arrow track of the bow body assembly; and when rotating in a second direction, the arrow support may move away from the arrow track of the bow body assembly.

Further, the elastic body may be provided with a limiting member for limiting the rebound of the elastic body after deformation.

The present disclosure involves manual winding, but the manual winding process will not exert any force on a limb, and the force to deform the limb is offered by moving the winding assembly by driving the sliding assembly by pedaling, which offers an obvious labor-saving effect. In a shooting phase, the winding assembly is fixed relative to the bow body, which improves energy efficiency like the fixed winding assembly in the prior art. In addition, the energy efficiency enhancer enables the winding wheel to continue to rotate after a limited number of revolutions, thereby further improving the overall energy efficiency of the bow. Further, as the winding wheel will not stop abruptly, noise is reduced.

DETAILED DESCRIPTION OF THE EMBODIMENTS

Figure 1:
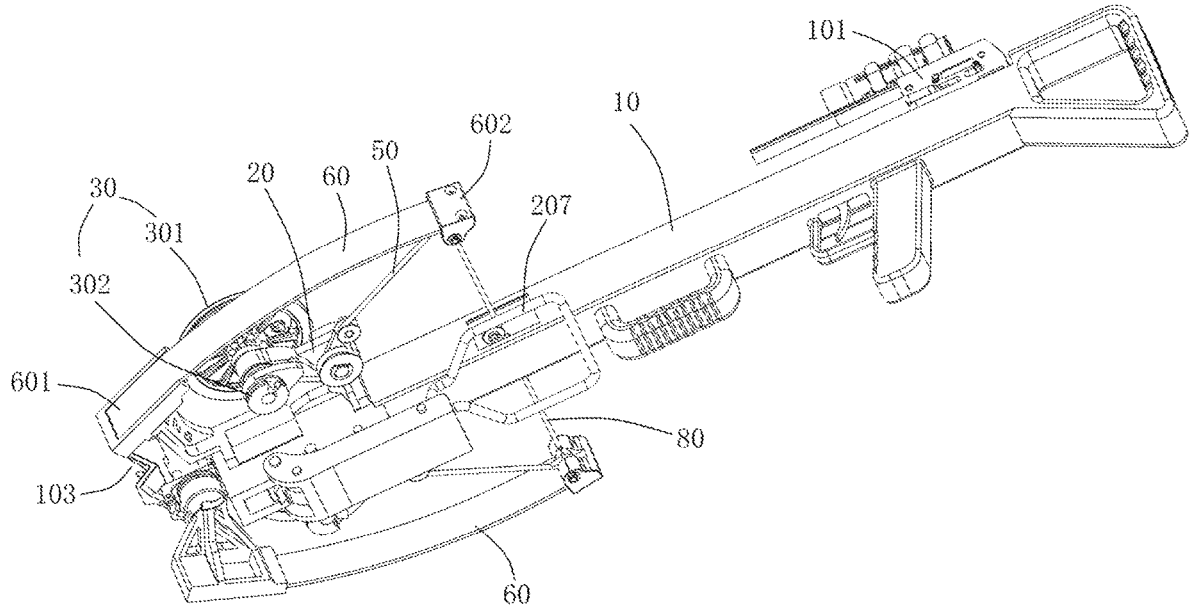
FIG. 1 is a full structural view of the present disclosure.

The present disclosure is further described in detail below with reference to the accompanying drawings and specific embodiments.

A bow assembly with a movable winding assembly includes a bow body assembly that pulls a string to shoot an arrow by a force generated by a rebound of an elastic body. The elastic body is a limb, which is usually in any form such as single-limb or double-limb. The bow body assembly includes a bow body, an arrow track and a trigger, etc. Bows usually include devices that shoot an arrow by an elastic force. The bow body assembly is pivotally connected to a winding assembly for winding the string. The winding assembly slides from a first position of the bow body assembly to a second position of the bow body assembly through a sliding assembly.

A connection point of the string on the winding assembly moves with the winding assembly. The string between the winding assembly and the elastic body carries and transmits a pulling force generated by the movement of the winding assembly to the elastic body, such that the elastic body is deformed to produce a rebounding force.

The string includes at least a first string and a second string.

One of the first string and the second string is wound on the winding assembly, and is unwound from the winding assembly by an external force.

The other string is connected between the winding assembly and the elastic body; an external force is transmitted to the winding assembly through the one string, and then transmitted to the elastic body through the other string to deform the elastic body. The elastic body is not directly connected to the string that receives the external force. This design can offer an obvious labor-saving effect.

The string connected between the winding assembly and the elastic body is always at an angle of less than 90° to the elastic body.

The first string and the second string have opposite winding directions on the winding assembly. Thus, when the winding assembly is rotated, the first string and the second string have different winding states.

The first string and the second string extend in the same direction as the moving direction of the winding assembly. Therefore, the pulling force generated by the movement of the winding assembly acts more directly on the strings in the same direction.

At least one pre-tensioning member is provided on the string. The pre-tensioning member rotates by its own torsion force to wind the string and shorten a length of the string. Alternatively, when the winding assembly moves, the pre-tensioning member rotates against its own torsion force to release the string, so as to compensate for a moving distance. The torsion in the pre-tensioning member can be achieved by an elastic member. The pre-tensioning member is designed to tighten the slack string, so the position and number of the pre-tensioning member are not limited, and the pre-tensioning member can be provided where necessary.

The sliding assembly drives the winding assembly to move under the action of an external force. The sliding assembly includes at least one rotating member. The rotating member rotates to drive the winding assembly matched there-with to move. There may also be two rotating members. Among them, one rotating member is directly matched with the winding assembly, and the other rotating member is used for transmission. When the rotating members rotate in one direction, the winding assembly is driven to move in one direction.

The rotating member is matched with an anchoring member that allows the rotating member to rotate in only one direction, which anchors the position of the winding assembly after movement. Releasing the restrictive effect of the anchoring member on the rotating member can make the rotating member rotate in another direction.

The winding assembly includes at least one winding wheel wound with the string. There may be one or more winding wheels provided as needed. An energy efficiency enhancer is provided between any winding wheel and the winding assembly, which allows the winding wheel to continue to rotate after the winding assembly stops rotating. The energy efficiency enhancer includes an elastic member with rotational torsion. A blocking assembly is provided between the winding wheel and the winding assembly in a direction opposite to the torsion direction. After the winding wheel is reversed to a certain position under the action of torsion, the blocking assembly blocks, such that the winding wheel and the winding assembly rotate synchronously.

The bow body assembly is provided with an arrow supporting structure. The arrow supporting structure includes an arrow support. The arrow support rotates with a central part thereof, which serves as a pivot point. When rotating in a first direction, the arrow support enters an arrow track of the bow body assembly. When rotating in a second direction, the arrow support moves away from the arrow track of the bow body assembly. The power source for controlling the rotation of the arrow support is a track member that rotates in situ. A surface of the track member is provided with a track groove, and the arrow support moves along the track groove to change in height.

The elastic body is provided with a limiting member for limiting the rebound of the elastic body after deformation. The limiting member prevents the elastic body from rebounding excessively, and the limiting member may be in form of a third string.

Embodiment 1

Figure 2:
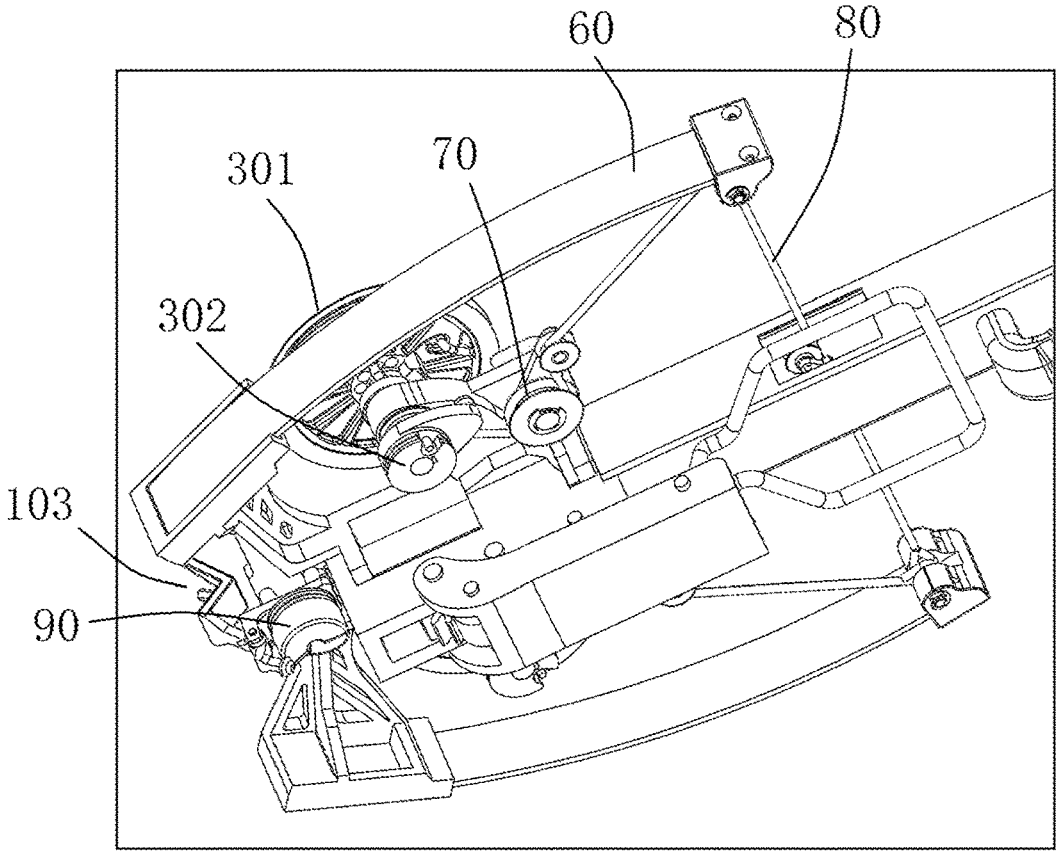
FIG. 2 is a partial structural view of the present disclosure.

As shown in FIGS. 1 and 2, a bow assembly with a movable winding assembly includes a bow body 10. A front end (cocking end) of the bow body 10 is provided with a winding assembly 30 through a slidable plate 20, which makes the winding assembly 30 movable rearwards and rearwards along the bow body 10 through the slidable plate 20. The winding assembly 30 includes winding wheels, which are symmetrically arranged on left and right sides of an arrow track. The winding wheels each include a major wheel 301 and a minor wheel 302 that are coaxially connected. The major wheels 301 on two sides of the arrow track are parallel to each other. When the major wheel 301 rotates, the minor wheel 302 rotates synchronously, and vice versa. A primary string 40 (first bow string) is wound on the major wheels 301. When the primary string 40 is pulled, the major wheels 301 on the two sides of the arrow track rotate in opposite directions. A secondary string 50 (second bow string) is wound on the minor wheels 302, and the winding direction of the secondary string 50 is opposite to that of the primary string 40. Therefore, when the primary string 40 is unwound, the secondary string 50 is taken up, and when the primary string 40 is taken up, the secondary string 50 is unwound.

Limbs 60 are further symmetrically arranged on left and right sides of the bow body 10. Front ends 601 of the limbs are connected and fixed to a front end of the bow body (equivalent to a bow head 103). Rear ends 602 of the limbs are free ends, where the secondary string 50 is wound. When the secondary string 50 is tightened, the free ends of the two limbs 60 are squeezed in a direction of the bow body 10, causing the limbs 60 to elastically deform to produce elastic potential energy.

Figure 13:
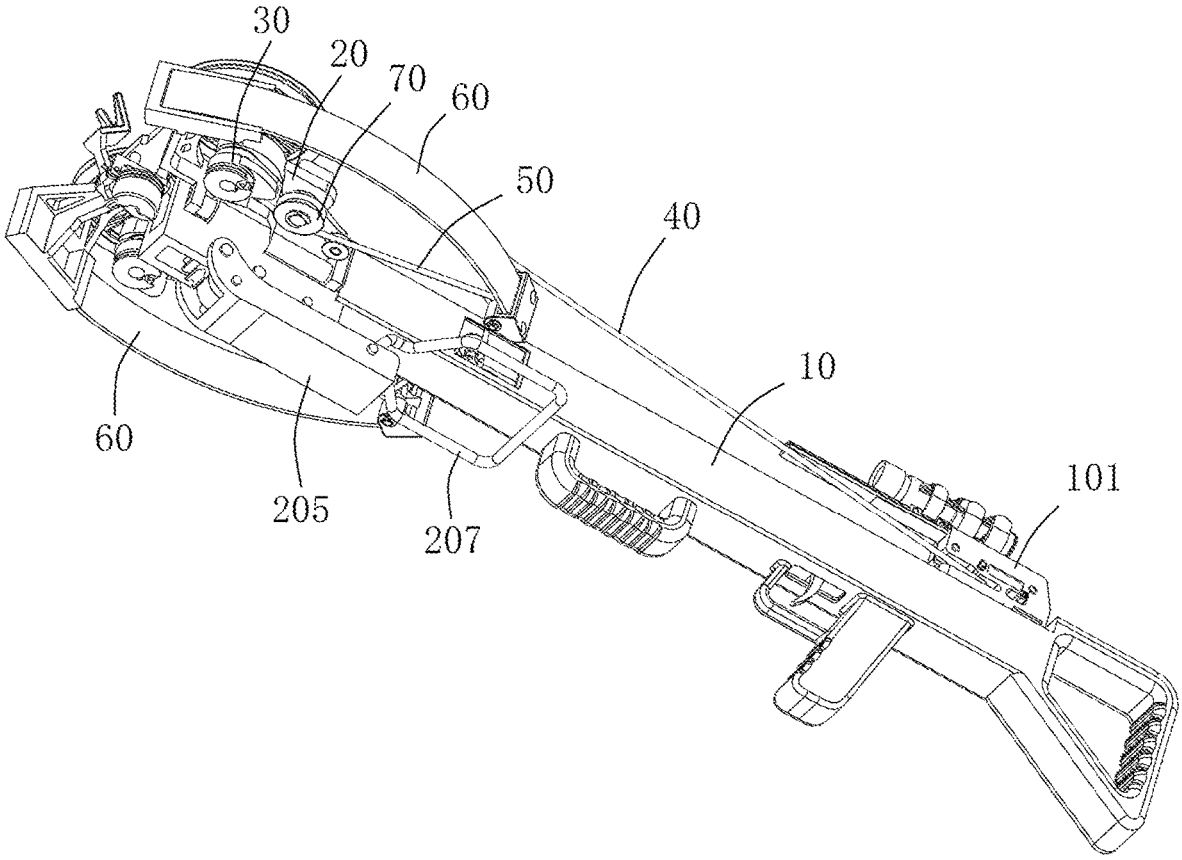
FIG. 13 is a full structural view of the crossbow after winding.

As shown in FIG. 13, when in use, the primary string 40 is first manually pulled rearwards, and the primary string 40 is hang on a trigger 101 located on a rear side of the bow body 10. Since the primary string 40 is pre-wound on the major wheels 301, when the primary string 40 is tightened, the major wheels 301 rotate. When the major wheels 301 rotate, the minor wheels 302 are driven to rotate synchronously. When the minor wheels 302 rotate, the secondary string 50 is taken up, but the shape of the limbs 60 is not changed.

The slidable plate 20 moves forward along the bow body 10 and drives the winding wheels as a whole to move forward together. The primary string 40 is tightened, and the tightened secondary string 50 moves forward as a whole. Under the pulling force of the secondary string 50, the free ends of the limbs 60 approach the bow body 10, such that the limbs 60 are deformed. The elastic potential energy of the limbs 60 is applied to the primary string 40 through the secondary string 50.

The positions of the slidable plate 20 and the winding wheels are kept unchanged, and the trigger 101 is pulled. The primary string 40 is released, and the primary string 40 loses its restrictive effect on the limbs 60. The limbs 60 quickly expand outward and rebound, and generate a pulling force on the secondary string 50 to reverse the minor wheels 302. The minor wheels 302 reverse to release the secondary string 50 to satisfy the rebound of the limbs 60. The reversing of the minor wheels 302 drives the major wheels 301 to reverse synchronously, such that the primary string 40 is taken up. In the take-up process, the primary string 40 does work on an arrow, such that the arrow is shot, as shown in FIG. 1.

In this embodiment, the winding process does not need to manually overcome gravity and the force of the limbs 60 to pull the primary string 40 onto the trigger 101 (prior art). On the contrary, the primary string is wound without a load, and the limbs 60 are bent due to the movable characteristic of the slidable plate 20. Compared with the hand-winding method, this embodiment is labor-saving.

In addition, the winding wheels and the limbs 60 are separate. The winding wheels will not lose the kinetic energy generated by the limbs 60, such that the energy efficiency of the arrow is improved and the arrow can fly faster.

Embodiment 2

Figure 3:
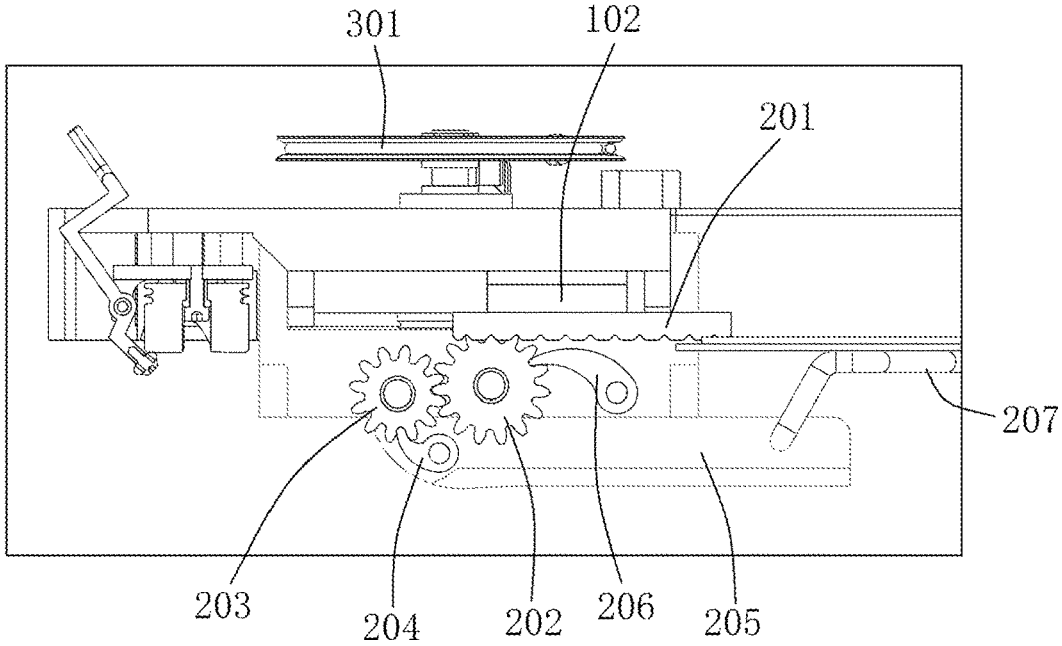
FIG. 3 is a sectional structural view of a sliding assembly of the present disclosure.

A bow assembly with movable winding wheels includes the winding wheels and the slidable plate 20 in Embodiment 1. As shown in FIGS. 1, 2 and 3, a bow body 10 is provided with a rail 102 for the slidable plate 20 to slide on. A rack 201 is provided at a lower end of the slidable plate 20. A driven gear 202 is meshed with the rack 201. The driven gear 202 meshes with a driving gear 203. When the driving gear 203 rotates, the driven gear 202 is driven to rotate. The position of the driven gear 202 is fixed, so the rack 201 is movable forwards and rearwards, such that the slidable plate 20 and the winding wheels as a whole are movable forwards and rearwards.

The driving gear 203 has a ratchet structure. The driving gear 203 is provided with a ratchet pawl A204 that cooperates with the ratchet wheel. The ratchet pawl A204 is provided on a connecting rod 205. The connecting rod 205 rotates with a shaft of the driving gear as a rotation center. When the connecting rod 205 rotates clockwise by a certain angle, the driving gear 203 meshed with the ratchet pawl A204 rotates clockwise. Thus, the driven gear 202 meshed with the driving gear rotates counterclockwise to drive the rack 201 to move forward.

The connecting rod 205 can automatically return to an initial position through the action of a tension spring. When the ratchet pawl A204 is driven to rotate counterclockwise, the ratchet pawl A204 will not limit the driving gear 203. Therefore, the connecting rod 205 will not affect the driving gear 203 when it returns.

Similarly, the driven gear 202 is provided with a ratchet pawl B206. The ratchet pawl B206 is fixed to the bow body 10, and the ratchet pawl B206 blocks the driven gear 202 from rotating. The limiting effect of the ratchet pawl B206 provides a large resistance to prevent the driven gear 202 from rotating, thereby preventing the slidable plate 20 and the winding wheels that have moved forward from sliding reward as a whole. Therefore, limbs 60 can be stabilized after being deformed.

A locking structure is provided on each of the ratchet pawl A204 and the ratchet pawl B206. The ratchet pawl A204 and the ratchet pawl B206 are fixed in a locked state. In a non-locked state, they are rotatable to release the abutment against the ratchet, such that the driving gear 203 and the driven gear 202 can reverse, thereby returning the slidable plate 20 and the winding wheels as a whole.

In addition, a pedal structure 207 is provided at a rear end of the connecting rod 205 to wind the string by pedaling. Each time the pedal structure is stepped on, the driving gear 203 rotates 45-90°. Continuously stepping on the pedal structure 4-5 times can move the slidable plate 20 together with the winding wheels to the front end of the bow body 10 as a whole. The pedaling action is dependent on a body weight, and a single pedaling can produce 40-50 kg of force. Therefore, it is much easier to wind the string by pedaling than directly by hand. In addition, the winding stroke in the prior art is very long, so correspondingly, it is necessary to overcome a greater force. In this embodiment, the winding stroke is very short, which is only the advance distance of the rack 201, which is much smaller than the length of the bow body 10.

Embodiment 3

A bow assembly with movable winding wheels includes the winding wheels and the slidable plate 20 in Embodiment 1. It may include the ratchet winding structure that drives the slidable plate 20 to move in Embodiment 2, and may further include pre-tensioning wheels 70.

Figure 4:
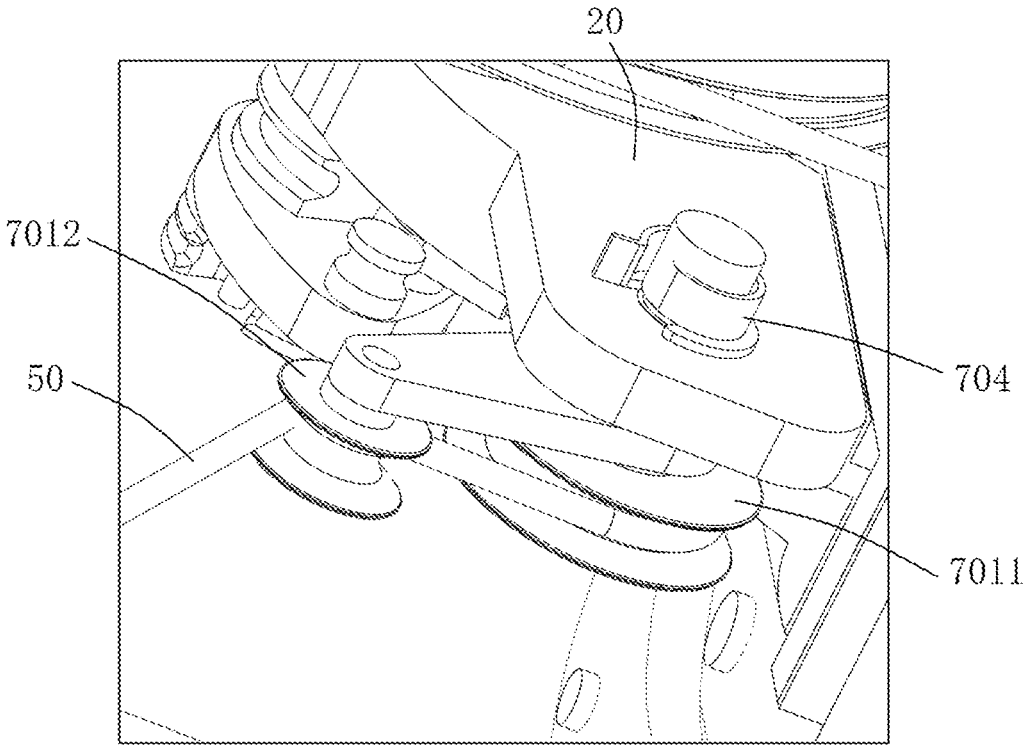
FIG. 4 is a schematic view of a pre-tensioning wheel provided on a crossbow according to the present disclosure.
Figure 5:
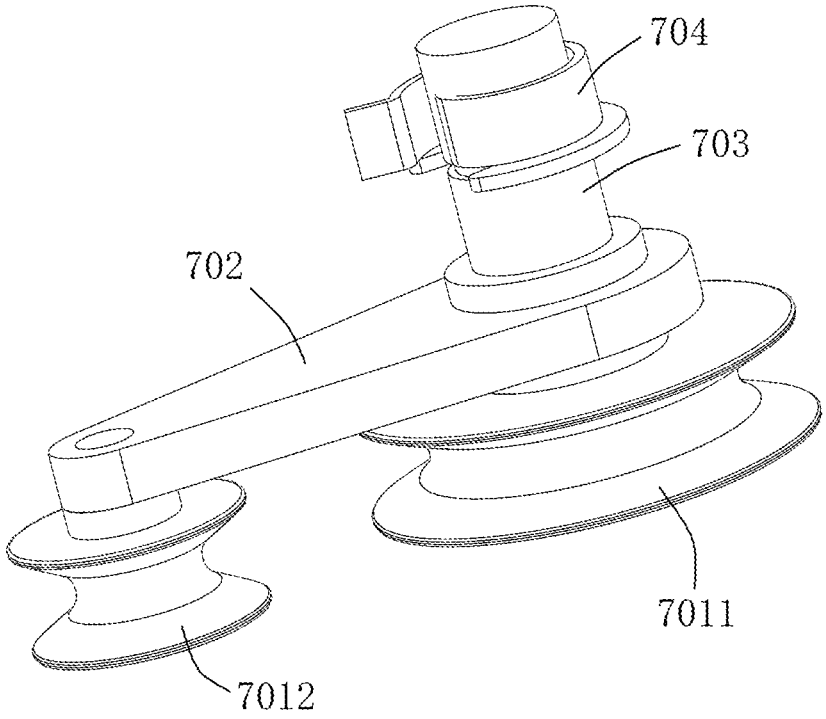
FIG. 5 is a full structural view of the pre-tensioning wheel.
Figure 6:
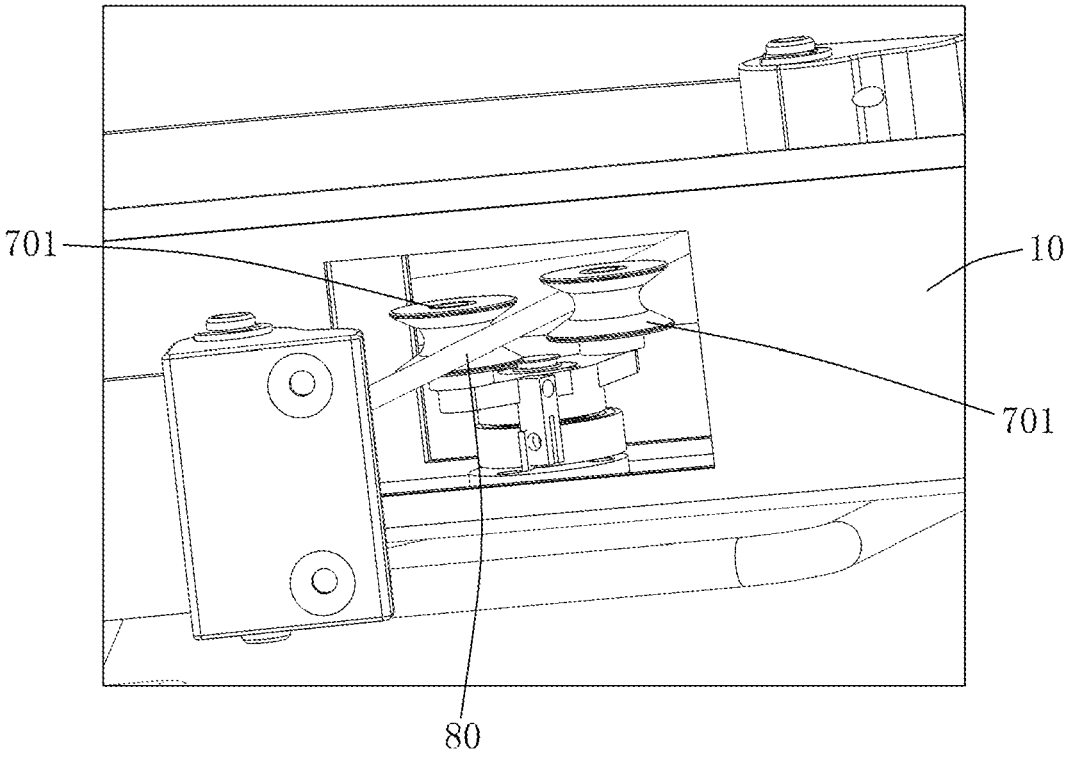
FIG. 6 is a structural view of the pre-tensioning wheel with a limit string.

A limit string 80 is provided with two guide pulleys 701. The two guide pulleys 701 can revolve around a midpoint of the connecting line of the two guide pulleys 701, as shown in FIG. 6. Alternatively, one guide pulley 701 revolves around the other guide pulley 701, which rotates on its own, as shown in FIGS. 4 and 5.

The two guide pulleys 701 are connected by a support 702. A central shaft 703 is provided on a back side of the support 702. A support base (not shown in the figure) is provided on the central shaft 703. Elastic components such as a torsion spring 704 are arranged between the central shaft 703 and the support base.

Figure 11:
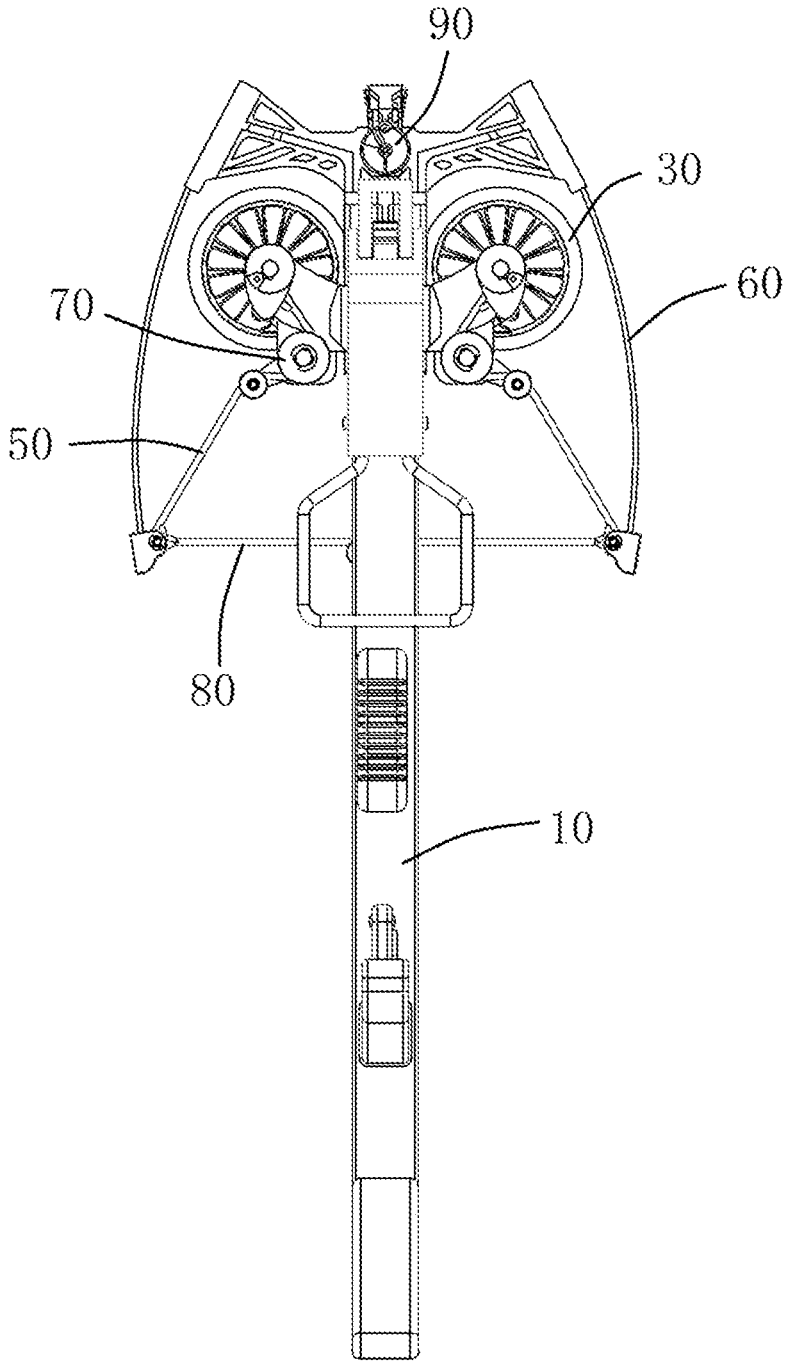
FIG. 11 shows an initial state of the crossbow before winding.
Figure 12:
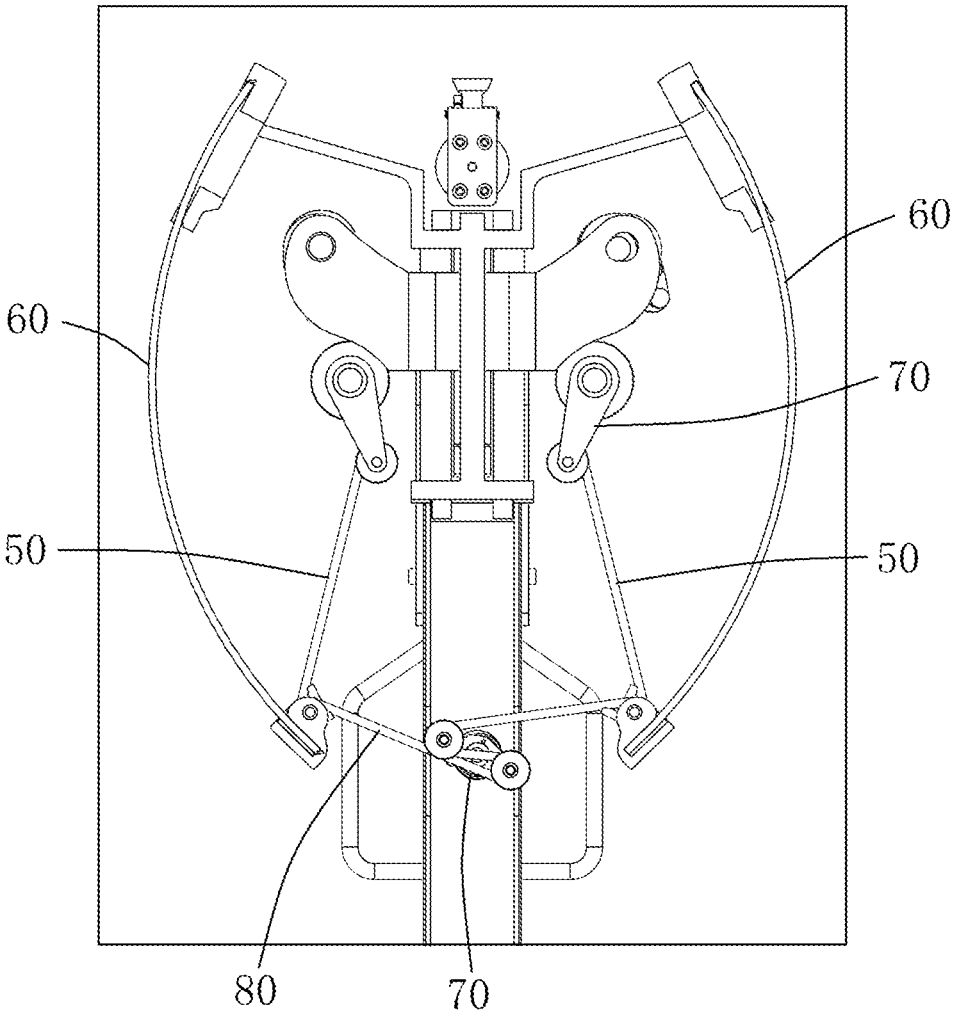
FIG. 12 is a partial structural view of the crossbow after winding.

When in use, the support 702 rotates in advance to overcome the force of the torsion spring 704 so as to generate a pre-tightening force on the limit string 80. The limit string 80 with the pre-tightening force is provided on a string path, and the limit string is laid in an S-shape between the two guide pulleys 701. After the limit string 80 is slack, the support 702 is driven to reverse under the action of the torsion spring 704, and then the limit string is wound on the two guide pulleys 701, as shown in FIGS. 11 and 12.

In this embodiment, the limit string 80 is provided on the path of the secondary string 50. Specifically, the central shaft 703 of the pre-tensioning wheel is provided on a bottom surface of the slidable plate 20. The support base is provided on a top surface of the slidable plate 20. The central shaft 703 is rotatably connected to the support base. The torsion spring 704 is provided between the support base and the central shaft 703, such that the central shaft 703 and the support 702 can do work on the torsion spring 704 when they rotate. The two guide pulleys 701 are coplanar with the minor wheels 302 of the winding wheels. The diameter of one guide pulley is larger than that of the other guide pulley. The large-diameter guide pulley 7011 is coaxial with the central shaft 703. With the large-diameter guide pulley 7011 as the center, the small-diameter guide pulley 7012 rotates around the large-diameter guide pulley 7011.

As shown in FIG. 4, an inside is defined as being close to the bow body 10, and an outside is defined as being away from the bow body 10. After the secondary string 50 is wound from the minor wheels 302, it is first wound on the large-diameter guide pulley 7011 from the inside, then wound on the small-diameter guide pulley 7012 from the outside, and finally fixed to the free ends of the limbs. During this process, the secondary string 50 is wound on the two guide pulleys 701 in an S-shape.

During winding, the primary string 40 is pulled such that the secondary string 50 is wound on the minor wheels 302. During this process, the length of the remaining secondary string 50 is shortened, such that the secondary string 50 wound in an S-shape over the limit string 80 overcomes the pre-tensioning force to become straight, as shown in FIG. 13. Therefore, during the winding process, only the force of the torsion spring 704 over the limit string 80 needs to be overcome.

The pre-tensioning wheels after winding are shown in FIG. 12.

When an arrow is shot, the limbs 60 pull the secondary string 50 and release the secondary string 50 from the minor wheels 302. After the arrow is shot, a large part of the secondary string 50 is outside the minor wheels 302, which causes the secondary string 50 to be slack. The slack secondary string 50 may cause the secondary string 50 to be detached when it is wound on the minor wheels 302. The slack secondary string 50 no longer exerts a force on the limit string 80, and the torsion spring 704 of the pre-tensioning wheel restores to winds the secondary string 50 on the pre-tensioning wheel, so as to maintain the tension of the secondary string 50, as shown in FIG. 11.

In this embodiment, since the distance between the winding wheel and the trigger 101 is close to the entire length of the bow body 10, the torque is very large. The secondary string 50 is directly in contact with the limbs 60. If the torque is too large, the transmission effect of the secondary string 50 will decrease, and the slack string will affect the aesthetics of the bow body 10 and cause the string to be detached. Therefore, the limit string 80 is provided on the path of the secondary string 50 to tighten the slack secondary string 50 so as to effectively reduce the loss of kinetic energy and prevent the string from detaching when the secondary string 50 is driving.

Embodiment 4

A bow assembly with movable winding wheels includes the winding wheels and the slidable plate 20 in Embodiment 1 and the limit string 80 in Embodiment 3. It may include the ratchet winding structure that drives the slidable plate 20 to move in Embodiment 2, and may further include a limit string 80 connecting the free ends of the two limbs. The limit string 80 pulls the free ends of the limbs to prevent the limbs 60 from expanding to both sides when rebounding, as shown in FIGS. 1, 2, 12, 13, and 14.

In this embodiment, a window is provided in a central part of the bow body 10 for the limit string 80 to pass through. The window is provided with the limit string 80 as described in Embodiment 3. The limit string 80 is provided on the bow body 10 on a bottom surface of the window. The two guide pulleys 701 of the pre-tensioning wheel rotate around the midpoint of the connecting line of the two guide pulleys 701, and the limit string 80 is wound in an S-shape on the two pre-tensioning wheels.

When the limbs 60 are not deformed, the distance between the free ends of the two limbs is the farthest, and the limit string 80 is tightened, such that the secondary string 50 wound on the pre-tensioning wheels in an S-shape overcomes the pre-tightening force to become straight.

When the limbs 60 are deformed, the distance between the free ends of the two limbs is reduced, such that the limit string 80 is slack. The slack limit string 80 does not exert any force on the torsion spring 704. The torsion spring 704 restores, and the two guide pulleys 701 are rotated to wind the limit string 80. The limit string 80 wound on the pre-tensioning wheels is kept straight between the free ends of the two limbs.

At this time, the role of the pre-tensioning wheels is to accommodate the excess length of the limit string 80, and to keep the limit string 80 always in a tightened state.

Embodiment 5

Figure 7:
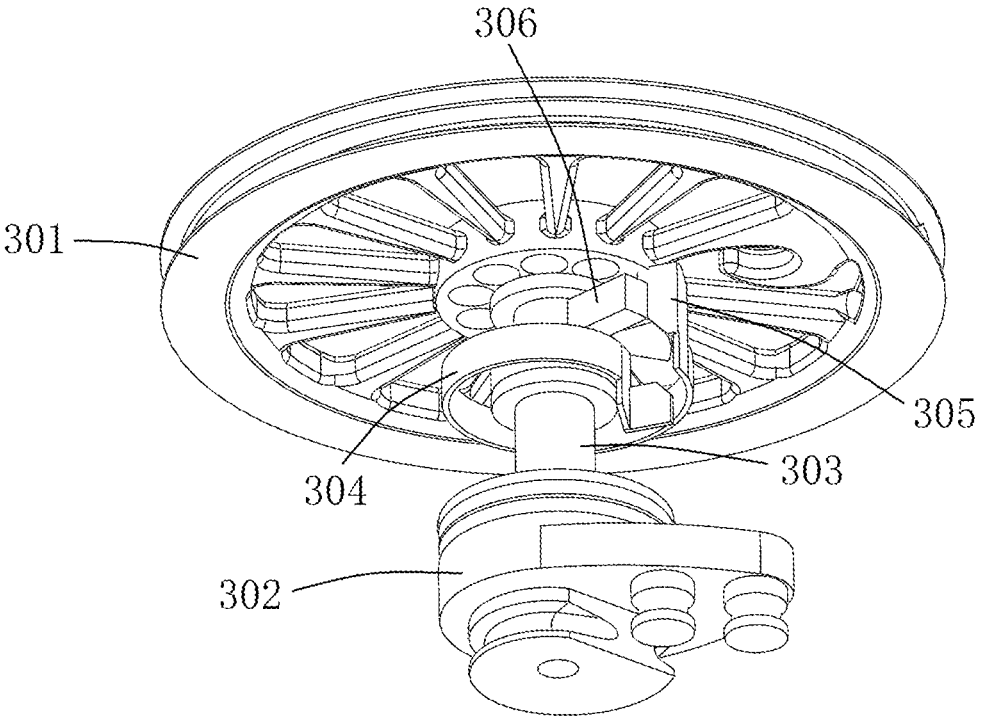
FIG. 7 is a full structural view of a winding wheel.
Figure 8:
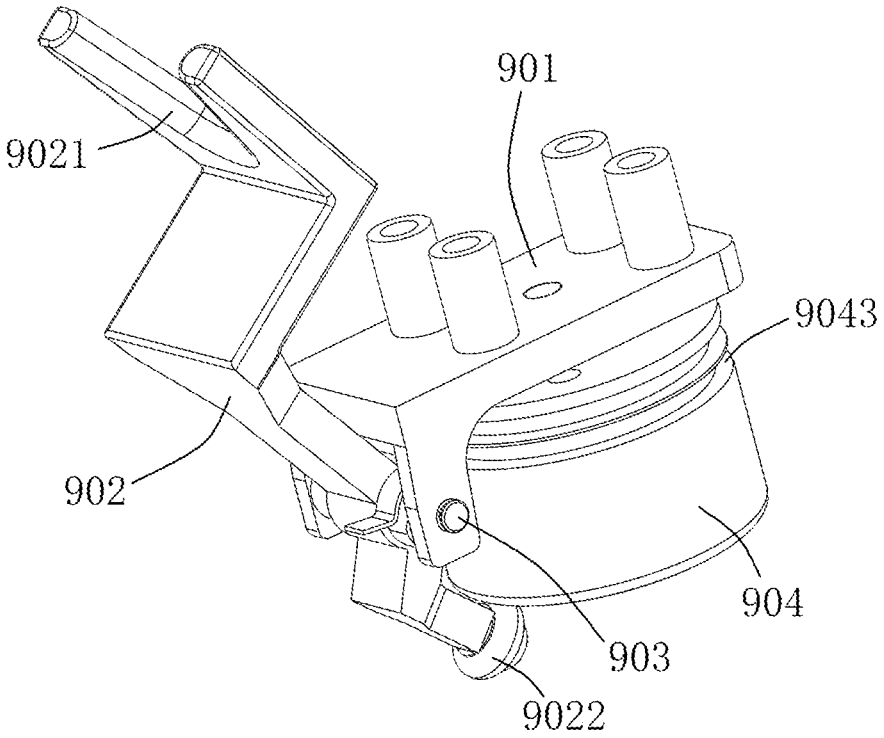
FIG. 8 is a full structural view of an arrow rest.
Figure 9:
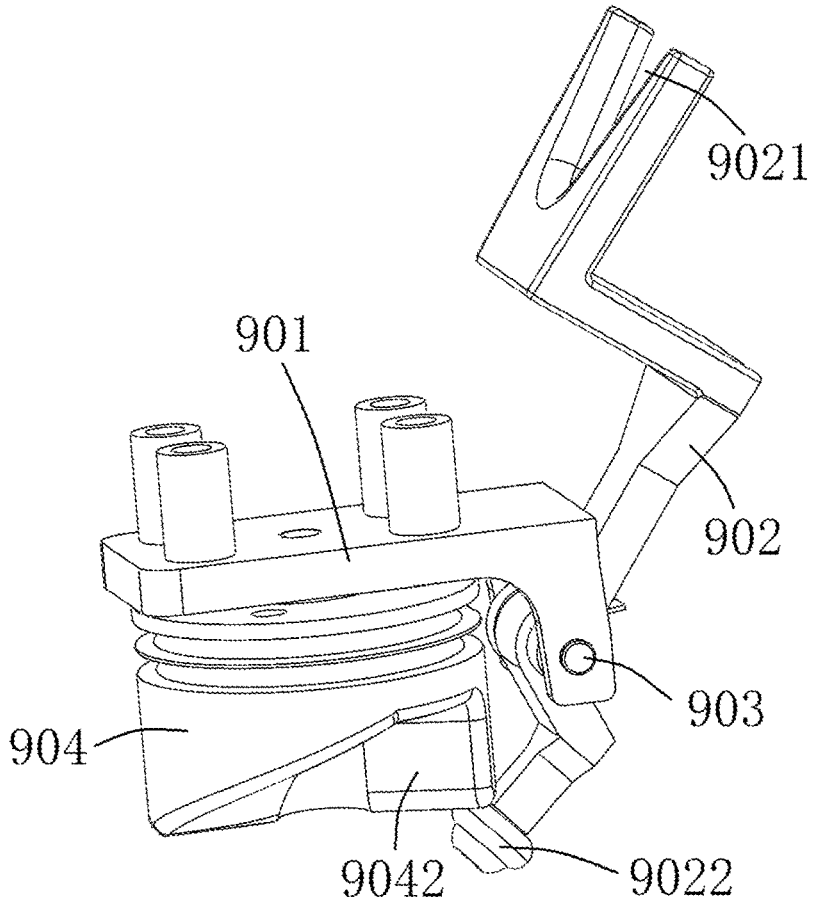
FIG. 9 is a lateral structural view of the arrow rest.
Figure 10:
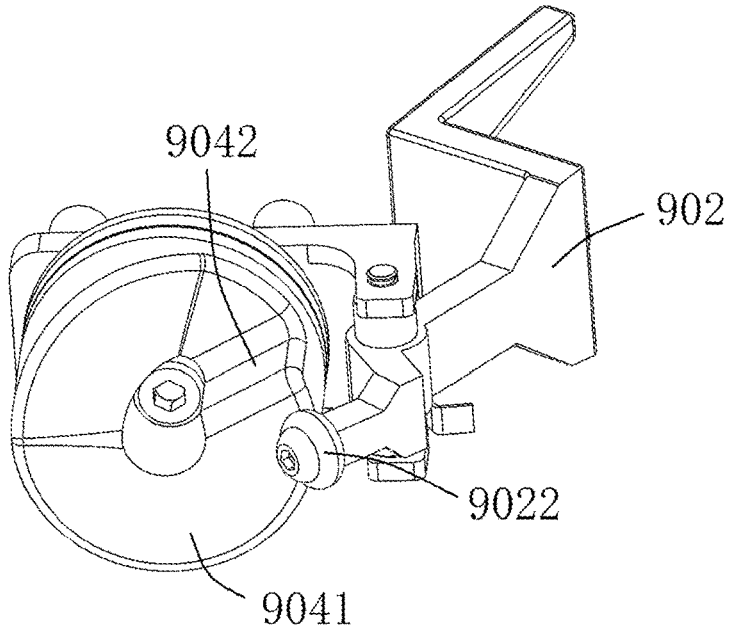
FIG. 10 is a bottom structural view of the arrow rest.

A bow assembly with movable winding wheels includes the winding wheels and the slidable plate 20 in Embodiment 1. As shown in FIGS. 1, 2 and 7, the major wheel 301 and the minor wheel 302 of each winding wheel are connected by a winding wheel shaft 303. The minor wheel 302 is fixed to the winding wheel shaft 303. An elastic member such as a torsion spring 304 is provided between the major wheel 301 and the winding wheel shaft 303.

An end of the winding wheel shaft 303 with the major wheel 301 is provided with a major wheel seat. The major wheel seat is axially fixed with a blocking seat 305. The major wheel 301 is axially fixed with a blocking piece 306. The blocking piece 306 is located on a back surface of the blocking seat 305. The blocking piece 306 and the blocking seat 305 are fixed through the torsion spring 304. One end of the torsion spring 304 is fixed to the major wheel 301, and the other end thereof is fixed to the major wheel seat.

In the winding phase, the primary string 40 drives the major wheel 301 to rotate. The major wheel 301 rotates, such that the blocking piece 306 rotates from the back surface of the blocking seat 305 to a front surface of the blocking seat 305. The major wheel 301 continues to rotate in the same direction. The blocking piece 306 is blocked by the blocking seat 305, and the blocking piece 306 drives the blocking seat 305 to rotate together. In this way, the rotation of the major wheel 301 is transmitted to the winding wheel shaft 303, and then to the minor wheel 302.

In the shooting phase, the limb 60 rebounds to drive the minor wheel 302 and the winding wheel shaft 303 to rotate in the opposite direction, such that the blocking seat 305 drives the blocking piece 306 to rotate in the opposite direction. Under natural circumstances, when the minor wheel 302 rotates to an extreme position, the minor wheel 302 stops rotating. The minor wheel 302 cannot continue to drive the major wheel 301 to rotate, and the arrow is shot away from the primary string 40. At this time, the rotation speed of the major wheel 301 is the fastest, and the kinetic energy generated by the rotation of the major wheel 301 is the greatest. Since the arrow leaves the primary string 40, the primary string 40 no longer exerts a force on the arrow. Therefore, the kinetic energy generated by the major wheel can only be absorbed through its own shock absorption and released through noise, so as to avoid waste of kinetic energy and avoid large noise.

In this embodiment, the stroke of the arrow can be extended by extending the primary string 40. When the minor wheel 302 cannot continue to drive the major wheel 301 to rotate, the force of the torsion spring 304 to restore the shape makes the major wheel 301 continue to rotate. The blocking piece 306 and the blocking seat 305 release their restriction function. This prevents the major wheel 301 from abruptly stopping at the fastest speed to cause a waste of kinetic energy. The kinetic energy generated by the rotation of the major wheel 301 continues to be transmitted to the arrow, thereby increasing the speed of the arrow. The major wheel 301 improves the utilization of kinetic energy, and correspondingly reduces the waste of kinetic energy, thereby reducing the generation of noise.

In terms of the arrow, during the shooting process, the primary string 40 does work on the arrow to make the arrow compress and deform, such that the arrow moves forward in a spiral trajectory after it is shot. Under the stroke of the existing primary string 40, the arrow will stretch and deform from the head end and the tail end under the action of its own deformation after leaving the primary string 40. The point where the arrow moves away from the primary string 40 is an off-string point. In this embodiment, the major wheel 301 is rotated by an additional angle through the action of the torsion spring 304 to extend the primary string 40, thereby extending the stroke of the primary string 40 on the arrow to make the arrow leave the primary string 40 later. When reaching the off-string point in the prior art, the arrow in this embodiment is still pushed by the primary string 40. The arrow only extends from the head end to restore its shape, so the speed of the arrow is improved in this embodiment.

Embodiment 6

A bow assembly with movable winding wheels includes the winding wheels and the slidable plate 20 in Embodiment 1. It further includes a height-adjustable arrow rest 90. As shown in FIGS. 1, 8, 9 and 10, the height-adjustable arrow rest 90 is located at the cocking end of the bow body 10. The height-adjustable arrow rest 90 includes an arrow rest stand 901 and an arrowhead bracket 902. The arrow rest stand 901 is fixed under the arrow track. A pivot point 903 is provided in a middle part of the arrowhead bracket 902. The arrowhead bracket 902 is pivotally connected to the arrow rest stand 901 through the pivot point 903, such that the arrowhead bracket 902 is rotatable vertically around the pivot point 903.

The arrowhead bracket 902 above the pivot point 903 is in a Z-shape. In the direction close to the arrow track, the arrowhead bracket 902 is provided with an arrow groove 9021 for an arrow to pass through. The arrowhead bracket 902 under the pivot point 903 is in an L shape bent rearward. In a direction away from the arrow track, the arrowhead bracket 902 defines a rotatable tip 9022.

A horizontally rotating take-up wheel 904 is provided below the arrow rest stand 901. A bottom surface of the take-up wheel 904 is provided with a slide 9041 that spirals upward or downward around a center of the bottom surface. The tip 9022 abuts against the slide 9041 on the bottom surface of the take-up wheel 904 via a spring. When the take-up wheel 904 rotates, the tip 9022 slides along the spiral slide 9041. As the sliding position of the tip 9022 changes, the tip 9022 changes in height with the height of the slide 9041 during the sliding process, further taking the pivot point 903 as a fulcrum. When the tip 9022 rises, the arrow groove 9021 descends. When the tip 9022 descends, the arrow groove 9021 rises. Before the arrow is shot, the arrow groove 9021 rises into the arrow track to support the arrow. After the arrow is shot, in order to prevent the arrow groove 9021 from scratching an arrow fletching to make the flying of the arrow instable, the arrow groove 9021 descends away from the arrow track to avoid the arrow fletching.

A wall 9042 is formed between a lowest point and a highest point of the slide 9041 located on the bottom surface of the take-up wheel 904. When the tip 9022 slides to the lowest point of the slide 9041, the wall 9042 plays a blocking role, such that the tip 9022 can only slide one circle around the slide 9041 and then can only slide in an opposite direction.

The rotation of the take-up wheel 904 may be driven by an arrow rest control string. A control method of this embodiment is as follows:

The take-up wheel 904 is provided with two take-up grooves 9043 coaxially. The winding wheels on both sides of the take-up wheel 904 are respectively provided with winding grooves corresponding to the take-up grooves 9043. The winding grooves may be respectively integrally formed with the minor wheels 302. The winding grooves have the same height as the corresponding take-up grooves 9043, which is convenient for winding arrow rest control strings (not shown in the figure) on the corresponding winding grooves and the take-up grooves 9043. In this way, the arrow rest control strings are wound in the two take-up grooves 9043, respectively. The other ends of the arrow rest control strings are wound on the corresponding winding grooves. The winding directions of the arrow rest control strings in the two take-up grooves 9043 are opposite. For example, when the arrow rest control string in an upper take-up groove 9043 is wound clockwise, the arrow rest control string in a lower take-up groove 9043 is wound counter-clockwise.

When the winding wheels rotate, they synchronously drive the arrow rest control strings to be taken up or unwound, thereby generating a (forward or reverse) rotational driving force on the take-up wheel 904. Thus, the arrow groove 9021 rises during winding and descends after shooting.

In order to adapt the arrow rest control strings to the distance change when the winding wheels move, the pre-tensioning wheel structure as described in Embodiment 3 is provided on the path of the arrow rest control strings. When the winding wheels move forward, the distance between the arrow rest and the winding wheels is shortened to slack the arrow rest control strings. The pre-tensioning wheels can wind the excess arrow rest control strings to keep the arrow rest control strings tight.

It should be noted that the above described embodiments are not intended to limit the present disclosure, and the present disclosure is not limited thereto. Changes, modifications, additions or replacements made by those skilled in the art based on the technical solutions of the present disclosure should fall within the protection scope of the present disclosure.

What is claimed is:

1. A bow assembly with a movable winding assembly, comprising a bow body assembly configured to pull a string to shoot an arrow by a force generated by a rebound of an elastic body, wherein the bow body assembly is pivotally connected to a winding assembly for winding the string;

the winding assembly slides from a first position of the bow body assembly to a second position of the bow body assembly through a sliding assembly; and a connection point of the string on the winding assembly moves with the winding assembly; and the string between the winding assembly and the elastic body carries and transmits a pulling force generated by a movement of the winding assembly to the elastic body, and the pulling force deforms the elastic body.

2. The bow assembly with the movable winding assembly according to claim 1, wherein the string comprises a first string and a second string.

3. The bow assembly with the movable winding assembly according to claim 2, wherein the first string is wound on the winding assembly, and is unwound from the winding assembly by an external force.

4. The bow assembly with the movable winding assembly according to claim 3, wherein the second string is connected between the winding assembly and the elastic body; an external force is transmitted to the winding assembly through the first string, and then transmitted to the elastic body through the second string to deform the elastic body; and the elastic body is not directly connected to the first string receiving the external force.

5. The bow assembly with the movable winding assembly according to claim 4, wherein the string connected between the winding assembly and the elastic body on the same side is always at an angle of less than 90° to the elastic body.

6. The bow assembly with the movable winding assembly according to claim 5, wherein the first string and the second string have opposite winding directions on the winding assembly.

7. The bow assembly with the movable winding assembly according to claim 6, wherein at least one pre-tensioning member is provided on the string; the at least one pre-tensioning member rotates by an own torsion force of the at least one pre-tensioning member to wind the string and shorten a length of the string; alternatively, when the winding assembly moves, the at least one pre-tensioning member rotates against the own torsion force of the at least one pre-tensioning member to release the string, so as to compensate for a moving distance.

8. The bow assembly with the movable winding assembly according to claim 7, wherein the sliding assembly drives the winding assembly to move under the action of an external force.

9. The bow assembly with the movable winding assembly according to claim 1, wherein the sliding assembly drives the winding assembly to move under the action of an external force.

10. The bow assembly with the movable winding assembly according to claim 9, wherein the sliding assembly comprises at least one rotating member.

11. The bow assembly with the movable winding assembly according to claim 10, wherein the at least one rotating member is matched with the winding assembly, and the at least one rotating member rotates to drive the winding assembly to move.

12. The bow assembly with the movable winding assembly according to claim 11, wherein the at least one rotating member is matched with an anchoring member, and the anchoring member allows the at least one rotating member to rotate in only one direction.

13. The bow assembly with the movable winding assembly according to claim 1, wherein the winding assembly comprises at least one winding wheel wound with the string.

14. The bow assembly with the movable winding assembly according to claim 13, wherein an energy efficiency enhancer is provided between the at least one winding wheel and the winding assembly, and the energy efficiency enhancer allows the at least one winding wheel to continue to rotate after the winding assembly stops rotating.

15. The bow assembly with the movable winding assembly according to claim 1, wherein the bow body assembly is provided with an arrow supporting structure.

16. The bow assembly with the movable winding assembly according to claim 15, wherein the arrow supporting structure comprises an arrow support.

17. The bow assembly with the movable winding assembly according to claim 16, wherein the arrow support rotates with a pivot point, and a central part of the arrow support serves as the pivot point.

18. The bow assembly with the movable winding assembly according to claim 17, wherein when the arrow support rotates in a first direction, the arrow support enters an arrow track of the bow body assembly.

19. The bow assembly with the movable winding assembly according to claim 18, wherein when the arrow support rotates in a second direction, the arrow support moves away from the arrow track of the bow body assembly.

20. The bow assembly with the movable winding assembly according to claim 1, wherein the elastic body is provided with a limiting member for limiting the rebound of the elastic body after deformation.

* * * * *